US008281613B2

(12) United States Patent
An et al.

(10) Patent No.: US 8,281,613 B2
(45) Date of Patent: Oct. 9, 2012

(54) ICE MAKER AND REFRIGERATOR HAVING THE SAME

(75) Inventors: Jae Koog An, Gwangju (KR); Jung Rae Kim, Seoul (KR); Jong Yeob Kim, Gwangju (KR)

(73) Assignee: Fujitsu Limited, Kawasaki (JP)

( * ) Notice: Subject to any disclaimer, the term of this patent is extended or adjusted under 35 U.S.C. 154(b) by 546 days.

(21) Appl. No.: 12/155,318

(22) Filed: Jun. 2, 2008

(65) Prior Publication Data

US 2008/0295539 A1 Dec. 4, 2008

(30) Foreign Application Priority Data

Jun. 4, 2007 (KR) ..... 10-2007-0054425

(51) Int. Cl.
*F25D 3/02* (2006.01)

(52) U.S. Cl. ..... 62/420; 62/353; 62/424; 62/425

(58) Field of Classification Search ..... 62/353, 62/420, 424–425
See application file for complete search history.

(56) References Cited

U.S. PATENT DOCUMENTS 6,588,227 B2 * 7/2003 Kim et al. ..... 62/344
6,945,068 B2 * 9/2005 Kim et al. ..... 62/353
7,240,510 B2 * 7/2007 Lee et al. ..... 62/353
7,464,565 B2 * 12/2008 Fu ..... 62/419

FOREIGN PATENT DOCUMENTS

KR 10-2006-0104479 10/2006

* cited by examiner

*Primary Examiner* — Cheryl J Tyler
*Assistant Examiner* — Jonathan Koagel
(74) *Attorney, Agent, or Firm* — Staas & Halsey LLP

(57) ABSTRACT

A refrigerator includes a refrigerator main body having a storage chamber, a door coupled to the refrigerator main body to be opened or closed, a cool air supplying device which generates cool air, an ice maker including an ice making tray having ice making cells to produce ice and a cool air guide member installed in the door, coupled to the ice making tray and having a cool air line that guides the cool air supplied from the cool air supplying device to flow around the ice making tray. The cool air line disposed on the cool air guide member to supply the ice making tray guides the cool air supplied from the cool air supplying device to move along the surrounding of the ice making tray, thereby uniformly cooling down the ice making tray.

7 Claims, 5 Drawing Sheets

ICE MAKER AND REFRIGERATOR HAVING THE SAME

CROSS-REFERENCE TO RELATED APPLICATIONS

This application claims the benefit of Korean Patent Application No. 2007-0054425, filed on Jun. 4, 2007 in the Korean Intellectual Property Office, the disclosure of which is incorporated herein by reference.

BACKGROUND

1. Field

The present invention relates to a refrigerator, and, more particularly, to an ice maker to make ice and a refrigerator having the ice maker.

2. Description of the Related Art

Generally, a refrigerator is a cooling chamber to store various food and beverages while cooling them and a freezing chamber to store frozen food while freezing them. The cooling chamber and the freezing chamber are separated by a partition wall and are opened and closed by different doors, respectively. Further, the refrigerator includes a cool air supply device supplying cool air to the cooling chamber and the freezing chamber.

Only one cool air supply device or a plurality of cool air supply devices may be disposed in the refrigerator. In the refrigerator including only one cool air supply device, the cooling chamber and the freezing chamber are cooled down by the one cool air supply device. In the refrigerator including a plurality of cool air supply devices, the cooling chamber and the freezing chamber are cooled down by different cool air supply devices, respectively.

Recently, a refrigerator including a dispenser has been developed such that the user can be provided with water and ice outside the refrigerator without opening the door. In order to supply ice using the dispenser, the refrigerator should include an ice maker to make ice, an ice storage container which stores ice made in the ice maker, and an ice feeding device which feeds the ice in the ice storage container to the dispenser.

The ice maker includes an ice making tray which is supplied with water to produce ice, and an ejector which discharges the ice from the ice making tray. The ice making tray is cooled down by the cool air supplied from the cool air supply device. When the cool air is supplied to the ice making tray supplied with water, the ice is produced in the ice making tray, and the produced ice is separated from the ice making tray by the ejector and drops into the ice storage container. The ice in the ice storage container is fed to the dispenser by the ice feeding device and, then the ice is discharged to the outside of the refrigerator by the dispenser.

The ice maker may be installed in the cooling chamber or the freezing chamber. Recently, a refrigerator in which the ice maker and the dispenser are installed in the door has been developed to prevent reduction of the storage space due to installation of the ice maker.

Korean Registered Patent No. 10-641120 discloses an example of a refrigerator including an ice maker installed in a door.

In the refrigerator disclosed in the Patent, both an ice maker and a dispenser are installed in a freezing chamber door. The cool air discharged from a cool air outlet installed at one side of a freezing chamber is supplied to the ice maker.

However, in the conventional refrigerator, since the cool air discharged from the cool air outlet moves to one side portion and an upper portion of the ice maker, the cool air is not supplied uniformly to the entire ice maker and is supplied to only one portion of the ice maker. Thus, the time to make ice becomes longer and the quality of ice is degraded.

SUMMARY

The present embodiment has been made in order to solve the above problems. It is an aspect of the embodiment to provide an ice maker improved to reduce the ice making time and provide ice of good quality and a refrigerator including the ice maker.

Additional aspects and/or advantages will be set forth in part in the description which follows and, in part, will be apparent from the description, or may be learned by practice of the invention.

The foregoing and/or other aspects are achieved by providing a refrigerator, including: a refrigerator main body having a storage chamber; a door coupled to the refrigerator main body to be opened or closed; a cool air supplying device which generates cool air; an ice maker including an ice making tray having ice making cells to produce ice and a cool air guide member installed in the door, coupled to the ice making tray and having a cool air line guiding the cool air supplied from the cool air supplying device to flow around the ice making tray.

The cool air line may include a rear flow path which guides the cool air to a rear side of the ice making tray and a lower flow path connected to the rear flow path to guide the cool air in the rear flow path to a lower portion of the ice making tray.

The cool air guide member includes a rear inlet port which communicates with the rear flow path to guide the cool air supplied from the cool air supplying device to the rear flow path, the rear inlet port being provided with a rear distribution plate having a plurality of rear distribution holes such that the cool air supplied to the rear inlet port is distributed and supplied to the rear flow path through the rear distribution holes.

The cool air guide member may include an upper distribution plate disposed at an upper portion of the ice making tray and having a plurality of upper distribution holes to distribute and supply the cool air to the upper portion of the ice making tray.

A water supply cup to supply water to the ice making tray may be disposed at one side of the cool air guide member and be integrally formed with the cool air guide member.

The foregoing and/or other aspects are achieved by providing an ice maker for a refrigerator, including: an ice making tray having ice making cells to produce ice; and a cool air guide member coupled to the ice making tray and having a cool air line that guides cool air to flow around the ice making tray.

The foregoing and/or other aspects are achieved by providing an ice maker of a refrigerator, including: a cool air supplying device supplying cool air; an ice making tray to make ice receiving the cool air supplied by the cool air supplying device; and a cool air guide member including an upper distribution plate, a rear distribution plate and a lower guide plate, the cool air guide member surrounding the ice making tray and causing the cool air to be supplied to an upper portion of the ice making tray, a rear side of the ice making tray and a lower portion of the ice making tray.

The upper distribution plate may include a plurality of upper distribution holes defined therein to supply the cool air to the upper portion of the ice making tray and to the front side of the ice making tray.

The rear distribution plate may include a plurality of rear distribution holes defined therein to supply the cool air to the rear of the ice making tray.

The cool air may be supplied along the lower guide plate to cool the lower portion of the ice making tray.

The ice maker may include an ice storage container storing the ice made by the ice making tray, wherein a portion of the cool air supplied along the lower guide plate of the ice making tray may be supplied to the ice storage container through a plurality of through holes defined within the lower guide plate, and a portion of the cool air may be supplied along the lower guide plate is supplied to a front side of the ice making tray together with cool air supplied to the front side of the ice making tray through a plurality of through holes defined within the upper distribution plate.

Additional aspects and/or advantages will be set forth in part in the description which follows and, in part, will be obvious from the description, or may be learned by practice of the invention.

BRIEF DESCRIPTION OF THE DRAWINGS

These and/or other aspects and advantages will become apparent and more readily appreciated from the following description of the embodiment, taken in conjunction with the accompanying drawings, of which.

DETAILED DESCRIPTION OF THE EMBODIMENT

Figure 1:
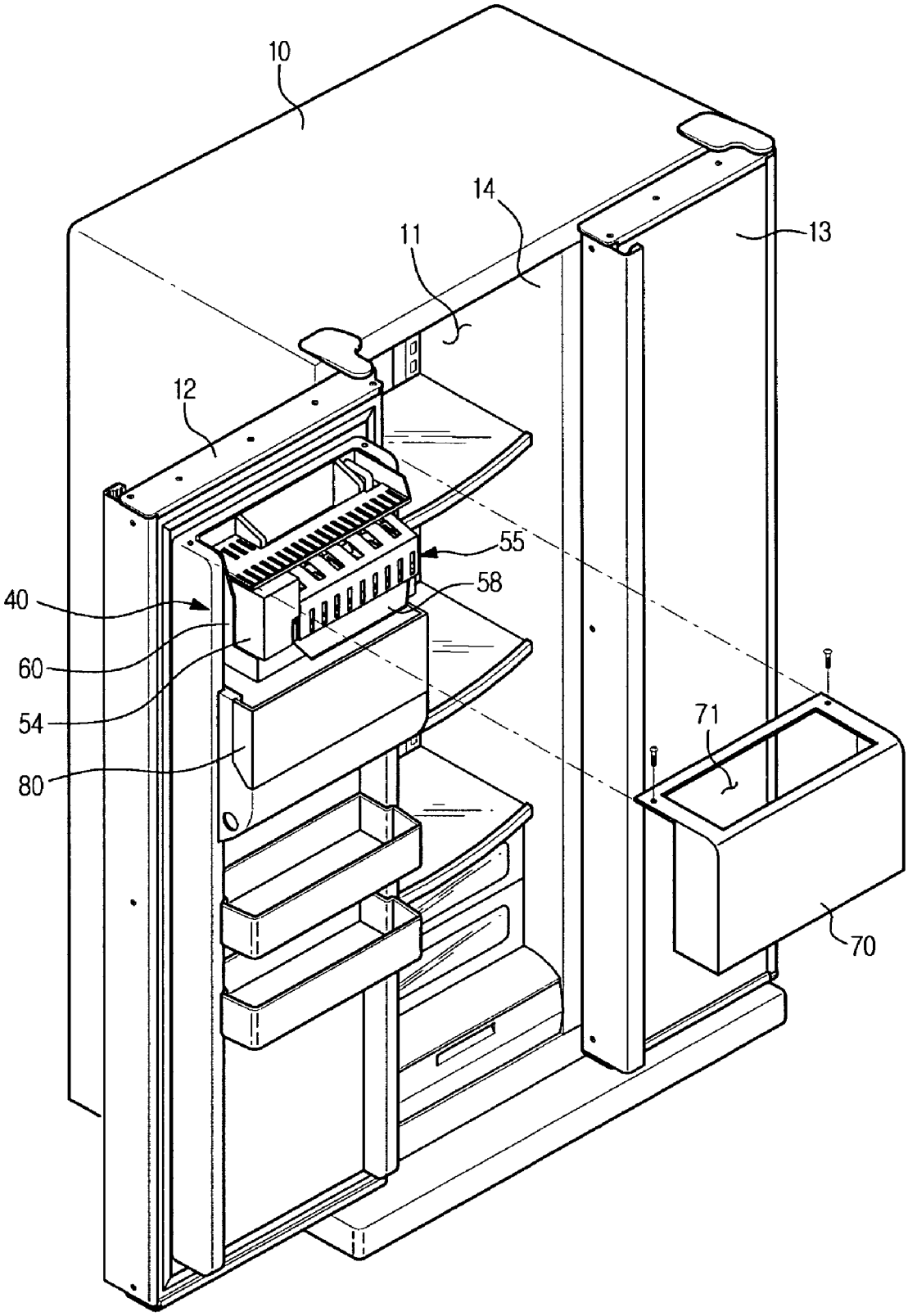
FIG. 1 is a perspective view schematically showing a refrigerator according to an embodiment.

Reference will now be made in detail to the embodiment, examples of which are illustrated in the accompanying drawings, wherein like reference numerals refer to like elements throughout. The embodiment is described below to explain the present invention by referring to the figures.

Hereinafter, a refrigerator and an ice maker included in the refrigerator according to an embodiment will be described with reference to the accompanying drawings.

Figure 2:
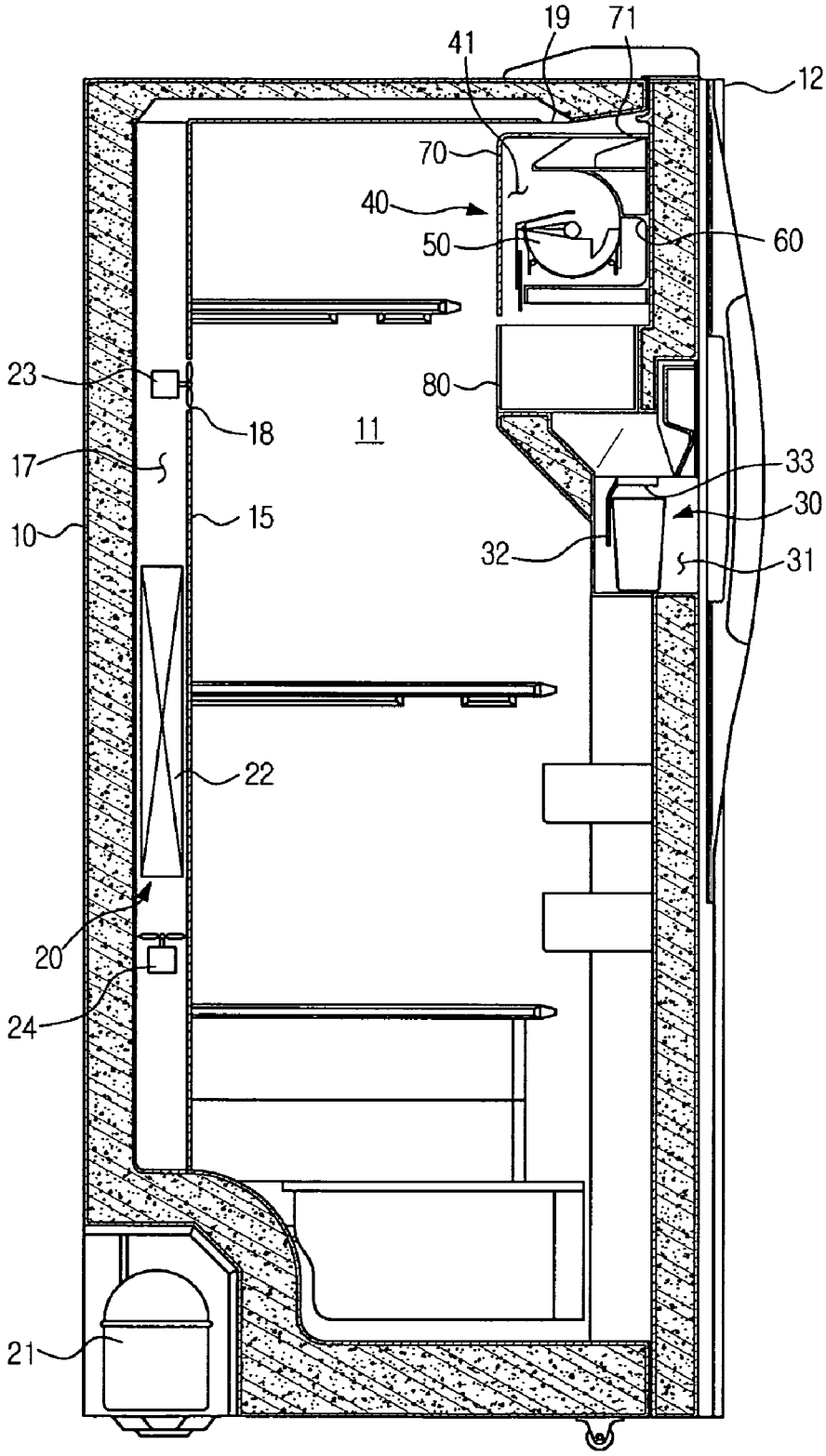
FIG. 2 is a side cross-sectional view schematically showing the refrigerator according to the embodiment.

As shown in FIGS. 1 and 2, a refrigerator according to the embodiment includes a refrigerator main body 10 including a freezing chamber 11 and a cooling chamber (not shown) therein, a freezing chamber door 12 and a cooling chamber door 13 coupled to the refrigerator main body 10 to open or close the freezing chamber 11 and the cooling chamber, a cool air supplying device 20 which generates cool air, a dispenser 30 which supplies ice, and an ice maker 40.

The refrigerator main body 10 includes an open front surface and an inside portion which is divided into the freezing chamber 11 and the cooling chamber by a partition wall 14. The freezing chamber door 12 and the cooling chamber door 13 may be hinge-coupled to the refrigerator main body 10, respectively.

The cool air supplying device 20 generates cool air by the heat exchange action of a coolant which circulates in a freezing cycle. The cool air supplying device 20 includes an evaporator 22 which cools down the surrounding air by evaporating the coolant which has passed through a compressor 21, and blowers 23 and 24 which forcibly blow the cooled air surrounding the evaporator 22 toward the freezing chamber 11.

The evaporator 22 is installed in a cool air supplying line 17 disposed in the refrigerator main body 10. The cool air supplying line 17 is disposed in a duct 15 disposed at the inner side of the refrigerator main body 10. A cool air discharge port 18 is disposed at one rear side of the duct 15 to communicate the cool air supplying line 17 with the freezing chamber 11. Another cool air discharge port 19 is disposed at one upper side of the duct 15 to guide cool air in the cool air supplying line 17 to the ice maker 40. Cool air generated in the cool air supplying line 17 forcibly discharges toward the freezing chamber 11 through the cool air discharge ports 18 and 19 by the blowers 23 and 24 installed in the cool air supplying line 17.

The refrigerator according to the present embodiment may include a single cool air supplying device which cools both the freezing chamber 11 and the cooling chamber. Otherwise, the refrigerator may include two cool air supplying devices which cool down the freezing chamber and the cooling chamber, respectively.

The ice maker 40 is installed in the freezing chamber door 12 together with the dispenser 30. An ice storage container 80 is installed between the ice maker 40 and the dispenser 30. An ice feeding device (not shown) is installed in the ice storage container 80. The ice dropping into the ice storage container 80 is fed to the dispenser 30 by the ice feeding device. As shown in FIG. 2, the dispenser 30 includes a container receiving portion 31 and an operating lever 32. The ice made in the ice maker 40 drops into the ice storage container 80. The ice in the ice storage container 80 is discharged to the outside through an ice discharge port 33 when the user pushes the operating lever 32. Since the ice storage container 80, the ice feeding device and the dispenser 30 are commonly-used, the detailed description thereof is omitted.

The ice maker 40 includes an ice making tray 50 to produce ice, a cool air guide member 60 installed in the freezing chamber door 12 to be coupled to the ice making tray 50, and an ice making cover 70 which covers the ice making tray 50 and the cool air guide member 60 to define an ice making room 41.

Figure 3:
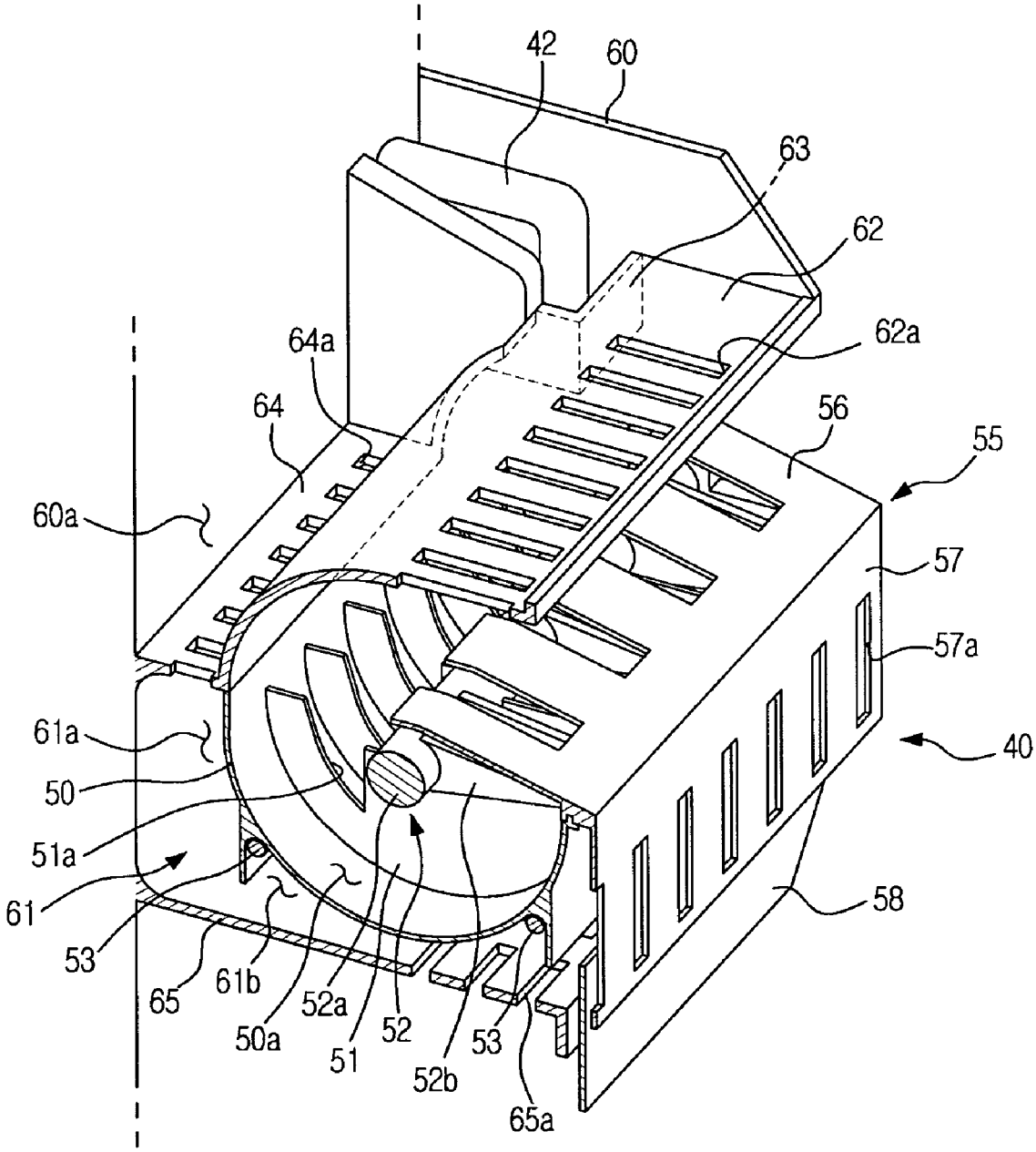
FIG. 3 is a cross-sectional perspective view schematically showing an ice maker according to the embodiment.

The ice making tray 50 may be made of metal, such as aluminum, having a high thermal conductivity. As shown in FIG. 3, the ice making tray 50 has a semicircular cylindrical shape with a semicircular cross section. Plural partitions 51 are arranged at specified intervals in the ice making tray 50, thereby forming plural semicircular ice making cells **50*a* in the ice making tray 50. The respective partitions 51 have a cut portion which is a passage 51*a*. Water supplied into one of the ice making cells 50*a* flows into the other adjacent ice making cell 50*a* through the passages 51*a* of the respective partitions 51. An ejector 52 is disposed on the partitions 51 to cross the ice making tray 50 such that the ice produced in the ice making cells 50*a* is discharged to the outside. The ejector 52 includes a rotational shaft 52*a* which is rotated by a driving device 54 (see FIG. 4) and a plurality of scrapers 52*b* installed at specified intervals along the rotational shaft 52*a* to correspond to the ice making cells 50*a*. If the rotational shaft 52*a* is rotated, the scrapers 52*b* push the ice produced in the ice making cells 50*a* to discharge the ice to the outside of the ice making tray 50**.

A heater 53 is installed under the ice making tray 50 to easily separate the ice produced in the ice making tray 50 from the bottom surface of the ice making tray 50. The heater 53 employs an electrical heating element which generates heat when power is supplied, etc. The bottom surface of the ice making tray 50 is heated before the ejector 52 is operated to smoothly discharge the ice by the ejector 52.

Further, a tray cover 55 is installed in front of the ice making tray 50. The tray cover 55 includes an ice guide portion 56 which guides the ice discharged from the ice making tray 50 by the ejector 52 to the ice storage container 80, and a lever protecting portion 57 which protects a filled ice lever 58 such that the filled ice lever 58 does not interfere with the ice stored in the ice storage container 80. The filled ice lever 58 detects a storage amount of the ice filled in the ice storage container 80 such that a proper amount of ice is stored in the ice storage container 80. The filled ice lever 58 is lifted up and down between the ice making tray 50 and the lever protecting portion 57 to detect the storage amount of the ice in the ice storage container 80. Since the specific structure and the effect of the filled ice lever 58 are well known, the detailed description thereof is omitted. The ice guide portion 56 of the tray cover 55 is provided to be inclined downward from one upper side of the ice making tray 50 to the front side. The ice which is pushed up from the bottom of the ice making tray 50 by the ejector 52 slides along the ice guide portion 56 and then drops into the ice storage container 80. Slotted through holes 57*a* are disposed on the lever protecting portion 57 to move cool air and heat generated in the heater 53. The through holes 57*a* are arranged at specified intervals in the length direction of the ice making tray 50 to smoothly move cool air or heat.

The cool air guide member 60 is coupled to an inner upper portion of the freezing chamber door 12 and to the ice making tray 50. As shown in FIG. 3, the cool air guide member 60 includes a cool air line 61 which guides supplied cool air to flow along a periphery of the ice making tray 50. The cool air line 61 includes a rear flow path 61*a* which guides the cool air to the rear side of the ice making tray 50 and a lower flow path 61*b* which guides the cool air in the rear flow path 61*a* to a lower portion of the ice making tray 50. Further, the cool air guide member 60 includes an upper distribution plate 62 which is disposed at an upper portion of the ice making tray 50 and has a plurality of upper distribution holes 62*a* to supply cool air to an upper portion of the ice making tray 50.

The upper distribution plate 62 is formed to cover an upper portion of the ice making tray 50 and has an arc-shaped cross section such that the rotating scrapers 52*b* do not interfere with the upper distribution plate 62. A plurality of slotted upper distribution holes 62*a* disposed on the upper distribution plate 62 are arranged at specified intervals such that cool air dropping from an upper wall of the refrigerator main body 10 is distributed and supplied uniformly to the upper portion of the ice making tray 50. A water supply cup 63 to supply water to the ice making tray 50 is disposed at one side of the upper distribution plate 62 such that the water supply cup 62 and the upper distribution plate 62 are formed as a single body. A water supply line 42 is installed in the water supply cup 63. The water supply line 42 is extended from the refrigerator main body 10 to the freezing chamber door 12. An end portion of the water supply line 42 is exposed to the inner side of the freezing chamber door 12 and disposed inside the water supply cup 63. The water supply cup 63 prevents water discharged from the water supply line 42 from splashing. The water supply cup 63 receives the water discharged from the water supply line 42 and supplies the water to the ice making tray 50. A water supply guide portion 63*a* (see FIG. 5) having a gradually reduced width is formed at a lower portion of the water supply cup 63 to be protruded downward in order to collect the water discharged from the water supply line 42 and guide the water to one upper side of the ice making tray 50.

Figure 4:
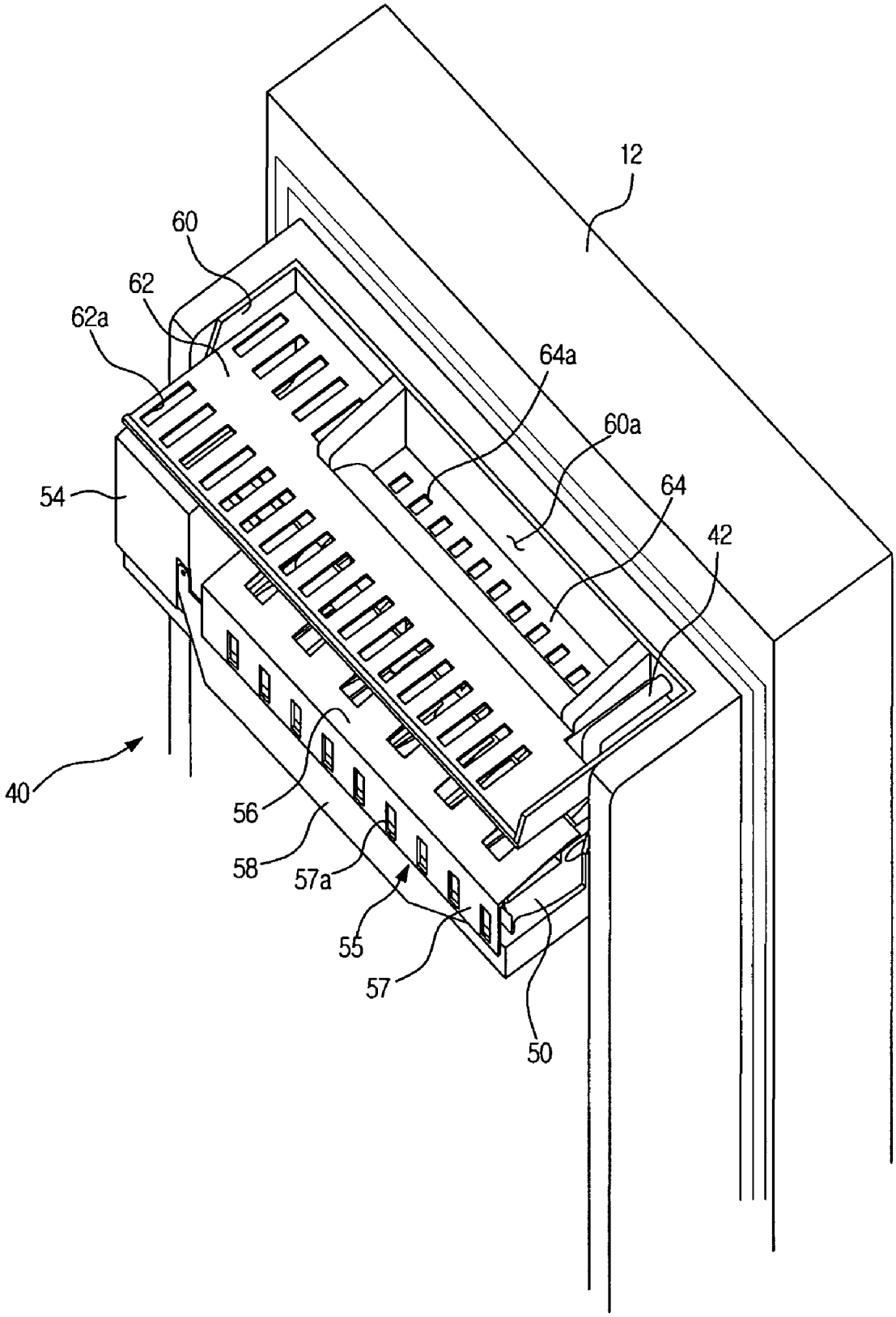
FIG. 4 is a perspective view schematically showing the ice maker according to the embodiment, which is installed in a door.

As shown in FIGS. 3 and 4, a rear inlet port 60*a* is disposed at the rear of the upper distribution plate 62 to guide cool air toward the rear flow path 61*a*. Further, a rear distribution plate 64 having a plurality of rear distribution holes 64*a* is disposed at the rear inlet port 60*a* to supply cool air flowing into the rear inlet port 60*a* to the rear flow path 61*a*. The rear distribution holes 64*a* are arranged at specified intervals to distribute and supply cool air uniformly to the rear flow path 61*a*. The cool air introduced into the rear flow path 61*a* flows toward a lower portion of the ice making tray 50 along the rear side of the ice making tray 50.

The cool air flowing toward the lower portion of the ice making tray 50 flows along the front side of the ice making tray 50 along the lower flow path 61*b* while cooling down the lower portion of the ice making tray 50. A lower guide plate 65 is disposed below the lower flow path 61*b* to guide cool air. A plurality of slotted through holes 65*a* is disposed at one front side of the lower guide plate 65 to supply cool air flowing along the lower flow path 61*b* to the ice storage container 80 under the ice maker 40. One portion of the cool air flowing along the lower flow path 61*b* to the front side of the ice making tray 50 flows into the ice storage container 80 through the through holes 65*a* of the lower guide plate 65. The other portion of the cool air flows to the front side of the ice making tray 50 to cool down the front side of the ice making tray 50 and, then is discharged between the ice making tray 50 and the tray cover 55 or through a through hole 57*a* of the tray cover 55. Further, the cool air which has cooled down the front side of the ice making tray 50 is introduced into the ice storage container 80 or is discharged to the freezing chamber 11 through a gap between the ice storage container 80 and the ice making cover 70.

As shown in FIGS. 1 and 2, the ice making cover 70 is coupled to the freezing chamber door 12 to cover the ice making tray 50 and the cool air guide member 60, thereby forming the ice making room 41 defined separately from the freezing chamber 11. A cool air supply opening 71 is defined through an upper portion of the ice making cover 70 such that the cool air discharged through the cool air discharge port 19 disposed on the upper wall of the refrigerator main body 10 is introduced into the ice making room 41. A lower portion of the ice making cover 70 is slightly spaced from an upper portion of the ice storage container 80. A gap is formed between the ice making cover 70 and the ice storage container 80 to allow cool air to flow through the gap.

Hereinafter, the operation of the ice maker 40 according to the embodiment will be described with reference to the accompanying drawings.

Figure 5:
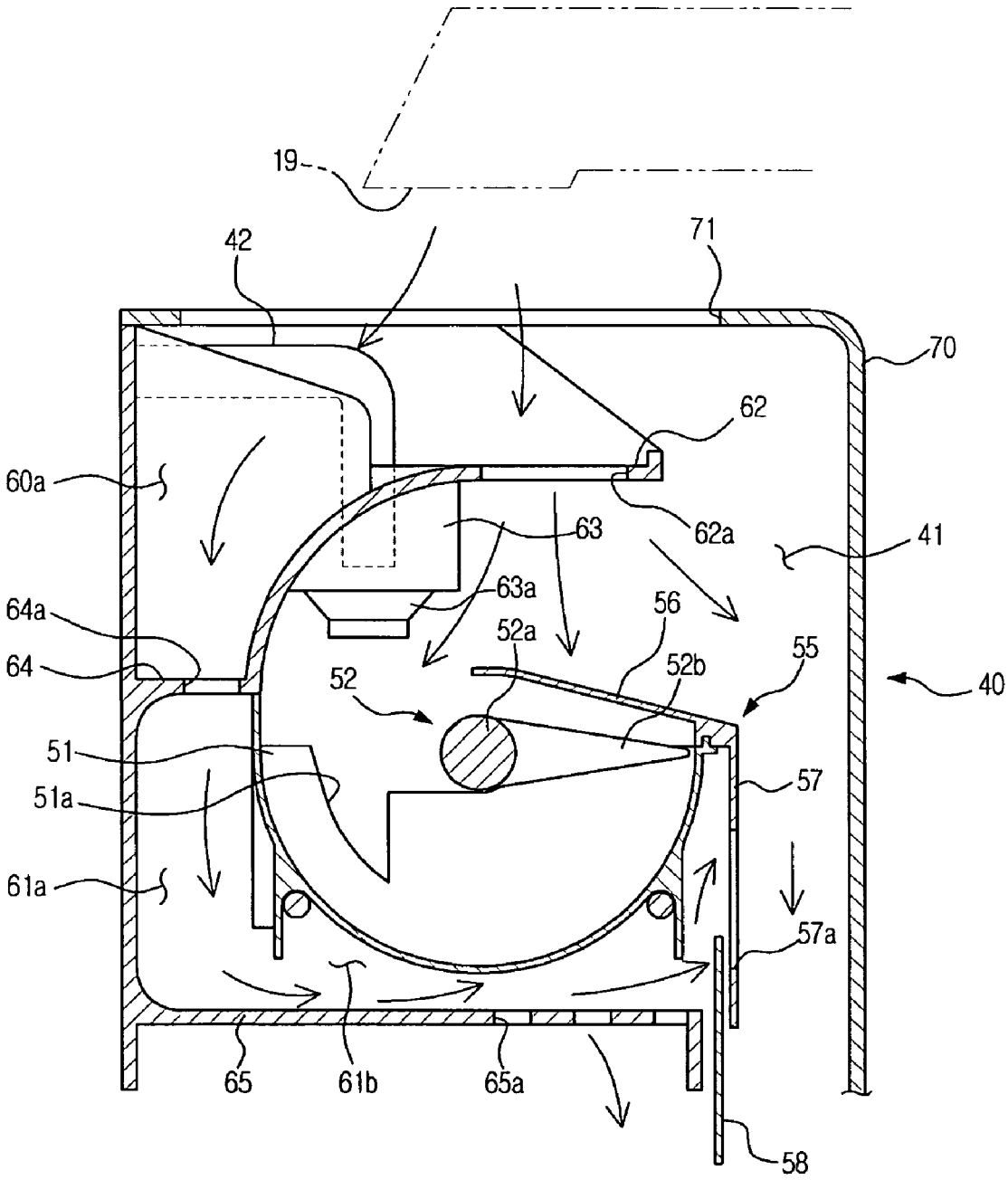
FIG. 5 is a side cross-sectional view for explaining the operation of the ice maker according to the embodiment.

As shown in FIG. 5, in order to make ice, first a proper amount of water is supplied into the ice making tray 50 through the water supply line 42 and the water supply cup 63. Then, the cool air generated in the cool air supplying device 20 passes through the cool air discharge port 19 defined through the upper wall of the refrigerator main body 10 and is supplied into the ice making room 41 through the cool air supply opening 71 of the ice making cover 70. The cool air supplied through the cool air supply opening 71 flows toward the upper distribution plate 62, the rear inlet port 60*a*, and the front side of the ice making tray 50. The cool air flowing toward the upper distribution plate 62 is distributed and supplied uniformly to the upper portion of the ice making tray 50 through the upper distribution holes 62*a* of the upper distribution plate 62 to directly cool down the water in the ice making tray 50. Further, the cool air flowing toward the rear inlet port 60*a* flows into the rear flow path 61*a* through the rear distribution holes 64*a* to uniformly cool down the rear side of the ice making tray 50.

The cool air dropping along the rear flow path 61*a* while cooling down the rear side of the ice making tray 50 flows from the rear side to the front side along the lower flow path 61*b* to uniformly cool down the lower portion of the ice making tray 50. One portion of the cool air which has cooled down the ice making tray 50 flows into the ice storage container 80 through the through holes 65*a* of the lower guide plate 65. The other portion of the cool air uniformly cools down the front side of the ice making tray 50 together with cool air supplied to the front side of the ice making tray 50.

As described above, the cool air supplied from the cool air supplying device 20 uniformly cools down the upper portion, the lower portion, the front side and the rear side of the ice making tray 50, that is, the surrounding of the ice making tray 50. Accordingly, the time to generate ice is shortened and the quality of ice is improved.

Meanwhile, in the present embodiment, the ice maker 40 and the dispenser 30 may be installed on the cooling chamber door 13.

According to the present embodiment, the cool air line disposed on the cool air guide member coupled to the ice making tray guides the cool air supplied from the cool air supplying device to move along the surrounding of the ice making tray, thereby uniformly cooling down the ice making tray. Thus, the time to generate ice is shortened and the quality of ice is improved.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A refrigerator, comprising:

a refrigerator main body having a storage chamber;

a door coupled to the refrigerator main body to be opened or closed;

a cool air supplying device installed at the refrigerator main body to generate cool air;

an ice making compartment provided at a rear of the door;

an ice maker installed in the ice making compartment provided at the rear of the door, the ice maker including an ice making tray to produce ice;

a cool air discharge port provided on an upper wall of the refrigerator main body, the cool air discharge port disposed above the ice making compartment to discharge the cool air generated from the cool air supplying device downwardly toward the ice making compartment;

a tray cover including an ice guide portion installed at a front discharge side of the ice making tray, which guides ice pieces discharged from the ice making tray by an elector into an ice storage container;

a guide member coupled to the ice making tray to guide the cool air from the cool air discharge port to the ice making tray when the door is closed, the guide member including an upper distribution portion disposed above the ice making tray to allow the cool air flowing downward from the cool air discharge port to pass through openings formed in the upper distribution portion toward an upper side of the ice making tray, a rear distribution portion extending to a rear side of the ice making tray from the upper distribution portion to guide the cool air flowing downward from the cool air discharge port to the rear side of the ice making tray; and a partition wall is provided in the ice making compartment below the ice making tray in a spaced apart relationship such that the cool air flowing downward along the rear side flows between a bottom surface of the ice making tray and the partition wall to directly expose the bottom surface to the cool air, and then flows along the front side of the ice making tray through the tray cover, wherein the upper distribution portion of the guide member is spaced above the ice guide portion of the tray cover to allow ice pieces discharged from the ice making tray to pass between the upper distribution portion and the ice guide portion.

2. The refrigerator according to claim 1, wherein the guide member has an interior surface that serves to guide ice pieces being discharged from the ice making tray, and an exterior surface that serves to guide cool air to flow along the exterior surface of the ice making tray.

3. The refrigerator according to claim 1, wherein a plurality of holes are provided at the partition wall to flow out cool air drawn in a non discharge side of the ice making tray.

4. The refrigerator according to claim 3, wherein the cool air introduced from the cool air discharge port flows to the upper distribution portion, and flows to the non discharge side of the ice making tray, and flows to a lower portion of the ice making tray, and then flows downward through the holes of the partition wall.

5. The refrigerator according to claim 1, wherein the cool air discharge port is extended toward the door from the upper wall of the refrigerator main body, and an outlet of the cool air discharge port is inclined downward to flow cool air toward the ice making compartment.

6. A refrigerator, comprising:

a refrigerator main body having a storage chamber;

a door coupled to the refrigerator main body to be opened or closed;

a cool air supplying device installed at the refrigerator main body to generate cool air;

an ice making compartment provided at a rear of the door;

an ice maker installed in the ice making compartment provided at the rear of the door, the ice maker including an ice making tray to produce ice;

a cool air discharge port provided on an upper wall of the refrigerator main body, the cool air discharge port disposed above the ice making compartment to discharge the cool air generated from the cool air supplying device downwardly toward the ice making compartment;

a tray cover including an ice guide portion installed at a front discharge side of the ice making tray, which guides ice pieces discharged from the ice making tray by an ejector into an ice storage container;

a guide member coupled to the ice making tray to guide the cool air from the cool air discharge port to the ice making tray when the door is closed, the guide member including an upper distribution portion disposed above the ice making tray to allow the cool air flowing downward from the cool air discharge port to pass through openings formed in the upper distribution portion toward an upper side of the ice making tray, a rear distribution portion extending to a rear side of the ice making tray from the upper distribution portion to guide the cool air flowing downward from the cool air discharge port to the rear side of the ice making tray; and a partition wall is provided in the ice making compartment below the ice making tray in a spaced apart relationship such that the cool air flowing downward along the rear side flows between a bottom surface of the ice making tray and the partition wall to directly expose the bottom surface to the cool air, and then flows along the front side of the ice making tray through the tray cover, wherein the upper distribution portion of the guide member is spaced above the ice guide portion of the tray cover to allow ice pieces discharged from the ice making tray to pass between the upper distribution portion and the ice guide portion, and wherein the cool air discharge port is extended toward the door from the upper wall of the refrigerator main body, and an outlet of the cool air discharge port is inclined downward to flow cool air toward the ice making compartment.

7. The refrigerator according to claim 6, wherein a plurality of holes are provided at the partition wall to flow out cool air drawn in a non discharge side of the ice making tray, and wherein the cool air introduced from the cool air discharge port flows to the upper distribution portion, and flows to the non discharge side of the ice making tray, and flows to a lower portion of the ice making tray, and then flows downward through the holes of the partition wall.

* * * * *

UNITED STATES PATENT AND TRADEMARK OFFICE

CERTIFICATE OF CORRECTION

PATENT NO. : 8,281,613 B2
APPLICATION NO. : 12/155318
DATED : October 9, 2012
INVENTOR(S) : Jae Koog An et al.

It is certified that error appears in the above-identified patent and that said Letters Patent is hereby corrected as shown below:

In the Claims:

Column 7; Line 61 (Approx.); In Claim 1, delete “elector” and insert -- ejector --, therefor.

Signed and Sealed this
Seventh Day of May, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,281,613 B2
APPLICATION NO. : 12/155318
DATED : October 9, 2012
INVENTOR(S) : An et al.

It is certified that error appears in the above-identified patent and that said Letters Patent is hereby corrected as shown below:

On the Title Page, Item [73] Assignee:

Delete "Fujitsu Limited, Kawasaki (JP)",
and insert -- Samsung Electronics Co., Ltd., Suwon-si (KR) --

Signed and Sealed this
Eighth Day of April, 2014

Michelle K. Lee

Michelle K. Lee
*Deputy Director of the United States Patent and Trademark Office*